US006177626B1

(12) United States Patent
Ishibashi

(10) Patent No.: US 6,177,626 B1
(45) Date of Patent: Jan. 23, 2001

(54) APPARATUS FOR SELECTING MUSIC BELONGING TO MULTI-GENRES

(75) Inventor: Masao Ishibashi, Hamamatsu (JP)

(73) Assignee: Yamaha Corporation, Hamamatsu (JP)

( * ) Notice: Under 35 U.S.C. 154(b), the term of this patent shall be extended for 0 days.

(21) Appl. No.: 09/458,359

(22) Filed: Dec. 9, 1999

(30) Foreign Application Priority Data

Dec. 10, 1998 (JP) ..... 10-351651

(51) Int. Cl.[7] ..... G10H 1/40

(52) U.S. Cl. ..... 84/635; 84/667; 84/DIG. 12; 84/477 R; 84/DIG. 6

(58) Field of Search ..... 84/611, 612, 635, 84/636, 651, 652, 667, 668, DIG. 12, DIG. 6, 477 R, 478

(56) References Cited

U.S. PATENT DOCUMENTS 5,696,343 12/1997 Nakata .

*Primary Examiner*—Stanley J. Witkowski

(74) *Attorney, Agent, or Firm*—Morrison & Foerster

(57) ABSTRACT

A music apparatus is constructed for selecting style data of a music piece by designating a style name of the music piece among a plurality of music pieces, which are sorted by genres. In the music apparatus, a style selection table is provided for recording selection codes assigned to the style names of the music pieces in a sorted manner by genres, such that different selection numbers may be assigned to the same style name when the music piece labeled thereby is sorted into more than one genre. A conversion table is provided for recording a correspondence between each selection code and each style name. A data memory is provided for storing each style data of each music piece in correspondence to the style name of each music piece. A monitor presents the selection codes together with the style names according to the style selection table in the sorted manner by the genres. A control is operated to designate a selection code from a desired genre presented on the monitor. A processor converts the designated selection code into the corresponding style name by means of the conversion table for retrieving the style data from the data memory according to the converted corresponding style name, thereby ensuring that the same style data is retrieved by designating one of the different selection codes assigned to the same style name.

17 Claims, 8 Drawing Sheets

APPARATUS FOR SELECTING MUSIC BELONGING TO MULTI-GENRES

BACKGROUND OF THE INVENTION

1. Field of the Invention

The present invention relates to a music selection apparatus. More specifically, the present invention relates to an automatic accompaniment apparatus used in an electronic musical apparatus for selecting desired music data among diverse music data that have been prepared and stored in advance.

2. Related Arts

In general, as a part of operations employed with a musical apparatus to select a desired music style for playing or reproduction, following the entry of an instruction using number keys, a series of style names are displayed in accordance with a record sequence that has been specified in advance. Thereafter, when a desired style name appears on a screen, a user can select the style by manipulating a decision switch. However, since individual styles are usually sorted to specific genres, and each style is recorded and stored in a memory area allocated for its assigned genre, a desired style cannot be selected until the genre to which the desired style has been sorted is displayed. In this case, only after a genre has been designated, style names that belong to the designated genre are displayed sequentially, thereby searching sequentially from the first one to the last one among the styles that were recorded in the designated genre.

Occasionally, some styles should belong to more than one genre. Even in such a case, the conventional music apparatus records each style at a memory location allotted to only one of the associated genres. Therefore, when a user wishes to select a desired style that belongs to a plurality of genres, in order to search for the desired style, the user must request that all the possibly applicable genres be displayed. For example, assuming that the style "JAZZ WALTZ" belonging to both the jazz genre and the waltz genre is recorded only in a memory area of the waltz genre, a user who desires to select this style must request the display of both the jazz genre and the waltz genre, and must complete the search of the jazz genre before beginning to search the waltz genre. Otherwise, the user must designate likely ones of the genres to be searched. Assuming that the "JAZZ WALTZ" style is recorded in the waltz genre area, when the user requests that the jazz genre be displayed first as the most likely one, the user could not find the target style. Only after the user has completed the search of the jazz genre, he or she will have to enter a second request for the display of the waltz genre as a next likely one. Thus, regardless of which method is used, the genre selection procedure tends to be repeated, and the work that must be performed before the desired style is found is trying and tedious.

SUMMARY OF THE INVENTION

To resolve this shortcoming, it is one objective of the present invention to provide a music selection apparatus wherein a style that belongs to a plurality of genres can be easily selected by scanning any of these genres, and wherein precise confirmation of a currently selected genre can be effected.

According to the first aspect of the invention, the music apparatus is constructed for selecting style data of a music piece by designating a style name of the music piece among a plurality of music pieces, which are sorted by genres. In the inventive apparatus, a style selection table is provided for recording selection codes assigned to the style names of the music pieces in a sorted manner by genres, such that different selection codes may be assigned to the same style name when the music piece labeled thereby is sorted into more than one genre. A conversion table is provided for recording a correspondence between each selection code and each style name. A data memory is provided for storing each style data of each music piece in correspondence to the style name of each music piece. A monitor presents the selection codes together with the style names according to the style selection table in the sorted manner by the genres. A control is operated to designate a selection code from a desired genre presented on the monitor. A processor converts the designated selection code into the corresponding style name by means of the conversion table for retrieving the style data from the data memory according to the converted corresponding style name, thereby ensuring that the same style data is retrieved by designating one of the different selection codes assigned to the same style name.

Preferably, the style selection table records a set of selection codes sequentially from a top selection code to a last selection code for each of a plurality of genres. In such a case, the monitor starts to present the set of the selection codes belonging to the desired genre from the top selection code when the control designates the desired genre among the plurality of the genres.

Preferably, the inventive apparatus further comprises an indicator that visually indicates the genre to which the selected music piece belongs according to the designated selection code with reference to the style selection table.

According to a second aspect of the invention, a music apparatus is constructed for selecting performance data of a music piece by designating a name of the music piece among a plurality of music pieces which are sorted by genres. In the inventive apparatus, a selection table is provided for recording selection codes assigned to the names of the music pieces in a sorted manner by genres, such that different selection codes may be assigned to the same name when the music piece labeled thereby is sorted into more than one genre. A data memory is provided for storing each performance data of each music piece in correspondence to the name of each music piece. A monitor presents the selection codes together with the names according to the selection table in the sorted manner by the genres. A control is operated to designate a selection code from a desired genre presented on the monitor. A processor retrieves the performance data of the music piece from the data memory according to the name of the music piece corresponding to the designated selection code. An indicator is provided for visually indicating the desired genre to which the selected music piece belongs according to the designated selection code with reference to the selection table.

In a more generic form, the inventive apparatus for selecting style data of a desired music piece comprises a data memory that stores style data of a plurality of music pieces, which are sorted by genres such that one music piece may belong to a multiple of genres and another music piece may belong to a single of genres, a first control that designates one of the genres so as to subject music pieces belonging to the designated genre for selection, a second control that selects one of the music pieces belonging to the designated genre, and a processor that retrieves the style data of the selected music piece from the data memory, thereby ensuring that the style data of said one music piece belonging to the multiple genres is retrieved by designating any one of the multiple genres.

Preferably, the data memory stores the style data of the music pieces together with identification codes for use in selection of the music pieces such that said one music piece belonging to the multiple genres is allotted multiple identification codes in correspondence to the multiple genres. Further, the inventive apparatus comprises an indicator that visually indicates the genre to which the selected music piece belongs according to the identification code, which is allotted in correspondence to the genre.

With respect to the first aspect of the present invention, in the music style selection table used for displaying a style name when a pertinent style is selected, a style that belongs to a plurality of genres is recorded in memory locations for all the associated genres by means of the selection codes. When the style is to be reproduced, style data thereof is specified by using the conversion table. Therefore, a style that belongs to a plurality of genres can be selected by scanning only one of these associated genres, hence the work involved in searching and selecting a desired style can be simplified. Moreover, in response to the designation of a genre to be displayed, there is presented the style name assigned the top selection code that is first recorded in the music style selection table. Therefore, the subsequent styles that belong to the desired genre can be displayed rapidly and sequentially.

With respect to the second aspect of the present invention, for the title or the style name of a music piece that belongs to a plurality of genres, before the performance data or the style data is selected, different selection codes or identification numbers are provided in the music selection table. By using the identification number or the selection code, a currently designated genre can be identified and displayed. Therefore, when the performance data or the style data of the music piece is selected, precise confirmation of the currently selected genre can be achieved.

DETAILED DESCRIPTION OF THE PREFERRED EMBODIMENTS

An appropriate and preferred embodiment will now be described in the form of an electronic musical apparatus that performs an automatic accompaniment or automatic playing (hereinafter referred to simply as automatic playing). It should be noted, however, that this embodiment is merely an example and can be variously modified without departing from the scope of the present invention.

Figure 1:
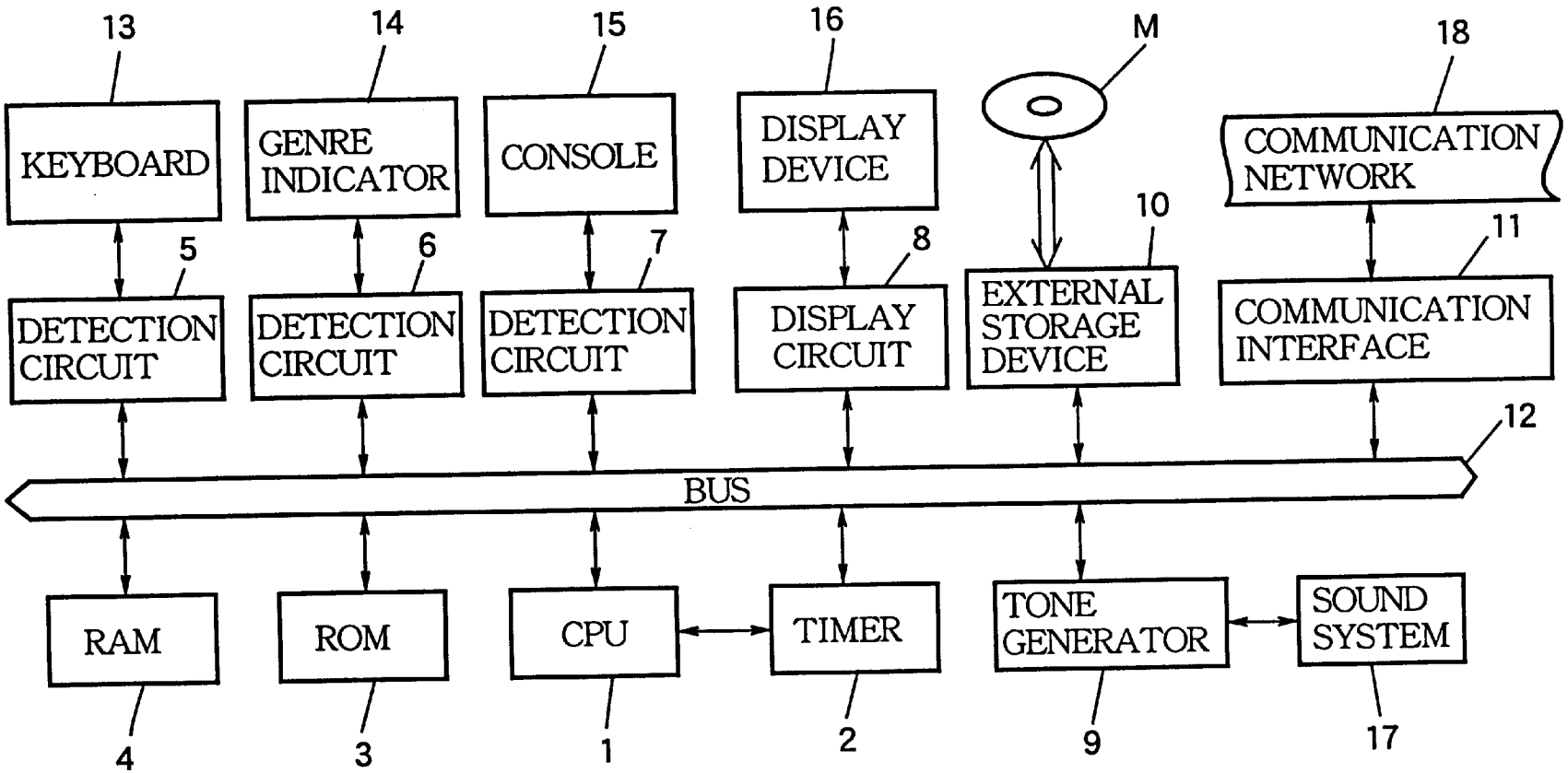
FIG. 1 is a block diagram showing a hardware arrangement according to one embodiment of the present invention.

FIG. 1 shows the hardware arrangement of the music selection apparatus integrated in the electronic musical apparatus according to one embodiment of the present invention. In this embodiment, the music selection apparatus is comprised of a central processing unit (CPU) 1, a timer 2, a read only memory (ROM) 3, a random access memory (RAM) 4, first to third detection circuits 5 to 7, a display circuit 8, a tone generator 9, an external storage device 10 and a communication interface 11. These sections are interconnected by a bus 12.

The CPU 1 controls the entire system and may incorporate the timer 2 for generating a tempo clock that is used for an interrupt process. The CPU 1 provides control for various functions in accordance with predetermined programs. In particular, the CPU 1 serves as a center to perform a music selection function. The ROM 3 stores predetermined programs for controlling the system. Included in these control programs are a basic performance data processing program and various other programs related to the music selection process performed according to this invention. Style data or performance data of music pieces can also be stored in the ROM 3. The RAM 4 is used as a work area for storing various parameters, a style selection table, a genre table and a conversion table, all of which are required for the above-mentioned style selection process. Various registers, a STYLE buffer, a RUN flag and a SELECT flag can also be temporarily prepared in the RAM 4.

A keyboard 13, a genre indicator 14 and a console 15 are connected to the first to the third detection circuits 5 to 7, respectively. A monitor display device 16 is connected to the display circuit 8. A sound system 17 is connected to the tone generator 9 for producing musical tones in accordance with style data or performance data. In this embodiment, the genre indicator 14 is so designed that LED lamps are provided in correspondence to multiple genres. A genre name is displayed in the vicinity of a corresponding LED lamp. In the console 15 required for the operation of the music selection apparatus of this invention, there are provided various input switches such as a "style select mode" switch, "INC" and "DEC" switches, a "genre" select switch and a "style" select switch. These switches are used to enter various instructions, selections and data. It is preferable that the genre select switch be provided with a LED lamp in correspondence to each genre name that is displayed by the genre indictor 14. A liquid crystal display, for example, is used as the monitor display device 16 on which a currently selected genre name and style name is presented. The screen of the display device 16 may be used as a touch panel that implements the input function equivalent to the switches of the console 15.

As the external storage device 10, one or a plurality of various storage devices, such as a hard disk drive (HDD), a floppy disk drive (FDD), a compact disk read only memory (CD-ROM) drive, a magneto-optical (MO) disk drive or a multi-purpose digital video disk (DVD) drive, are used as needed. Programs, tables and data that are required for the music selection process performed by this invention can be stored on a storage medium M loadable into the external storage device 10. Various style data and performance data can also be stored using, for example, a Musical Instrument Digital Interface (MIDI) format.

The system constituted by these units 1 to 17 may be an electronic musical instrument or an automatic playing apparatus. Otherwise, the inventive apparatus may also be constructed in another arbitrary form, such as a combination of a tone generator incorporated in a personal computer and application software. To supply data and programs to the personal computer, the application software may be stored on the storage medium M used in the external storage device 10, such as a magneto-optical disk, an optical disk or a semiconductor memory. The application software may also be supplied via a network. The present invention can also be applied to a music selection apparatus for a karaoke machine. In the system employed for the present invention, the communication interface 11 can be connected to the bus 12 so that the system can communicate with a server computer via a communication network 18.

In association with the system of this invention, an explanation will now be given for an example wherein a hard disk drive (HDD) or a CD-ROM drive is employed as the external storage device 10. The HDD is a storage device used for storing a control program and various data. When the control program is not stored in the ROM, the control program is stored on the disks in the HDD. When the program is loaded into the RAM, the program permits the CPU to perform the same operation as performed when the control program is stored in the ROM. Therefore, installing of a new control program and upgrading of a version are easy, since the CD-ROM drive is a device for reading a control program and various data stored on a removable CD. The control program and data that are read out can be stored on the hard disk in the HDD.

An explanation will also be given for an example wherein a program is downloaded using the communication network 18 that is connected to the communication interface 11. The communication network 18 is, for example, a Local Area Network (LAN), the Internet, or a public telephone network, that communicate with the server computer via the communication interface 11. The communication interface 11 is used to download a control program and associated data from the server computer when the control program and data are not stored in the ROM 3 or the HDD. The system of this invention, which serves as a client, directs a signal to a server computer, via the communication interface 11 and the communication network 18, requesting that a program or data be downloaded. Upon receiving this signal, the server computer transmits the requested program or data to the system via the communication network 18. The system receives the program or data via the communication interface 11, and stores the received materials on the storage device 10. In this fashion, the downloading is effected.

Figure 2:
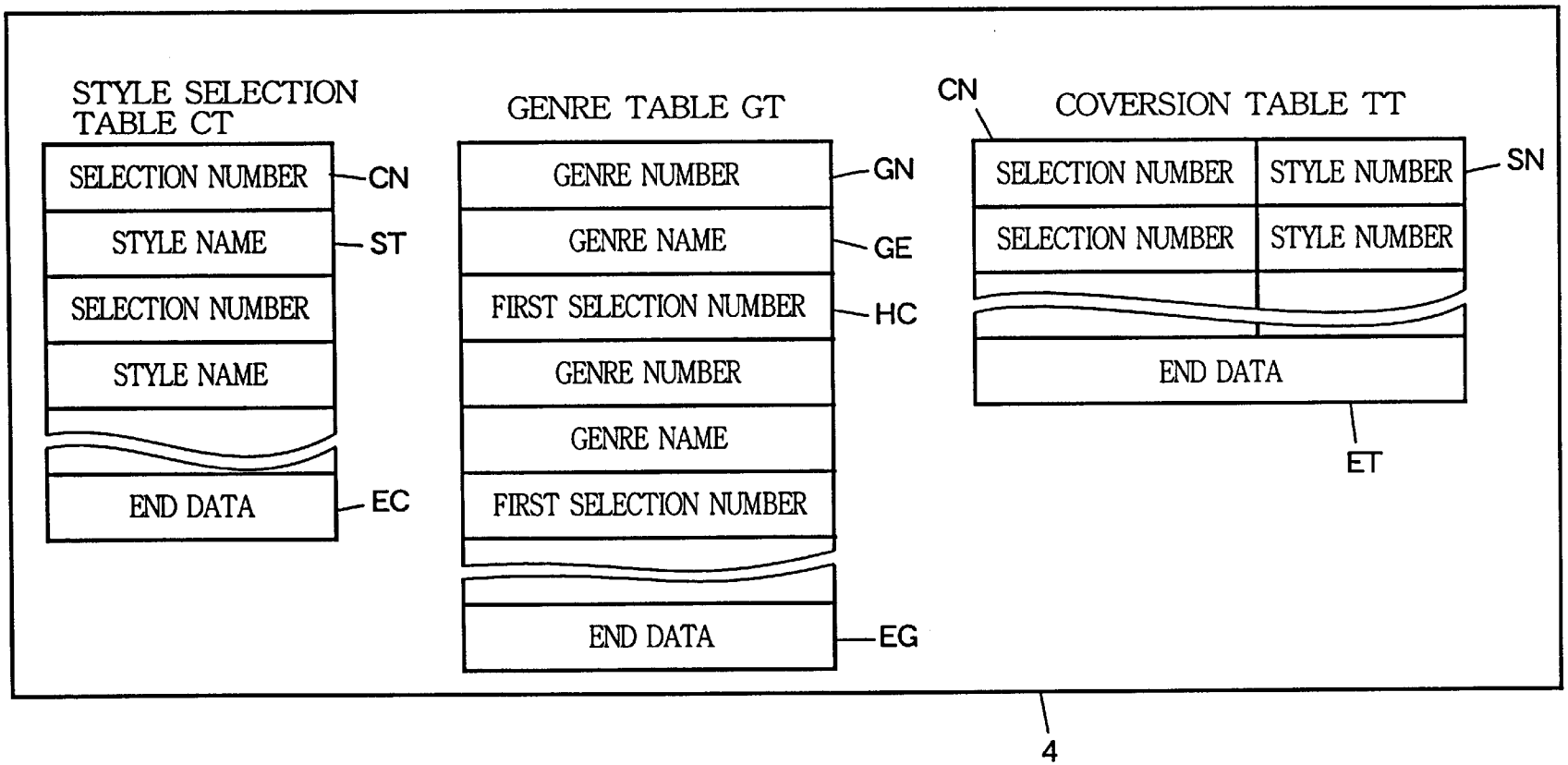
FIG. 2 is a diagram showing structures of various tables used in the embodiment of the present invention.
Figure 3:
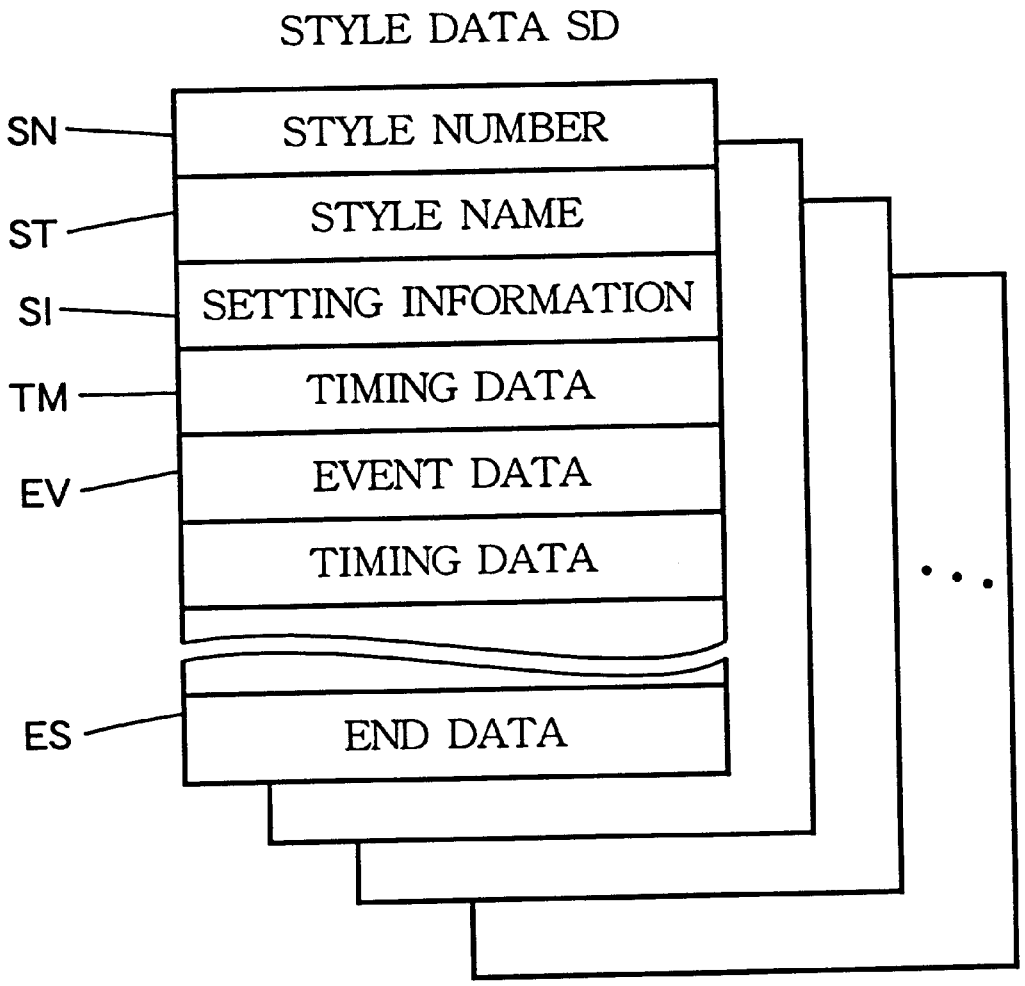
FIG. 3 is a diagram showing the structure of style data according to the embodiment of the present invention.

FIG. 2 is a diagram showing three tables CT, GT and TT that are used for music selection by the music selection apparatus of this embodiment according to the present invention. FIG. 3 is a diagram showing one example form of style data SD. In this example, the style data SD are stored in the ROM 3, while the style selection table CT, the genre table GT and the conversion table TT are stored in predetermined areas of the RAM 4.

A selection code is provided in the form of "style selection number CN," which functions as an individual identification code for style selection. Each style selection number and a corresponding "style name ST" are recorded as a pair and arranged in order with each genre in the style selection table CT. That is, in the table CT, all the style names ST that correspond to all the music pieces belonging to respective genres are arranged in a predetermined order, and are sorted in accordance with a predetermined genre sequence. The style selection numbers CN are provided as individual identification codes for the individual style names. As is shown in FIG. 2, the style selection number CN and the corresponding style name ST are arranged sequentially, and style selection end data EC is entered at the end of the table CT. Also, in the style selection table CT, the style name ST for a style or music piece belonging to a plurality of genres is recorded with different selection numbers CN at the pertinent genres. Therefore, the style or music piece can be selected from any of the listed genres by using the style selection table CT.

The genre table GT registers a top or first style selection number HC, which is recorded first in the recording sequence for each genre in the style selection table CT. That is, in the table GT, a top selection number HC assigned to a first style that belongs to each genre is entered together with a "genre number GN" and a corresponding "genre name GE". In the genre table GT, the number of sets composed of the foregoing three entries that are entered is equivalent to the number of the genres. At the end of the genre table GT, the genre end data EG is entered. When this table GT is employed for the style display in the genre selection process, the style name ST for a desired genre can be immediately displayed for the first style (music piece) that is located at the top of each genre. Further, when the table GT is employed for style selection, the genre that corresponds to the selection number (CN) of the selected style can be displayed.

In the conversion table TT, the style names are recorded in terms of style numbers SN in correspondence to the respective style selection numbers CN recorded in the style selection table CT. That is, in the conversion table TT, pairs of selection numbers CN and style numbers SN that correspond to the style names ST are arranged sequentially in the order of the style selection numbers. Conversion end data ET is entered at the end of the conversion table TT. When a style name that belongs to different genres is selected from one of the pertinent genres, the style data can be read by referring to the conversion table TT.

As is shown in FIG. 3, the style data SD is a group of automatic performance data. At the end of each automatic performance data, style end data ES is placed. The style data SD are prepared as sets of automatic performance data in a number equivalent to the number of the styles or music pieces. Each of the style data includes a style number SN, a style name ST, setting information SI, timing data TM and event data EV, arranged in a time series. The setting information SI is a collection of various items of setup data provided for determining tempos and timbres that are set for automatic accompaniment or automatic playing using the style data SD.

As described above, according to the first aspect of the invention, the music apparatus is constructed for selecting style data SD of a music piece by designating a style name ST of the music piece among a plurality of music pieces, which are sorted by genres. In the inventive apparatus, the style selection table CT is provided for recording selection codes in the form of selection numbers CN assigned to the style names ST of the music pieces in a sorted manner by genres, such that different selection numbers CN may be assigned to the same style name ST when the music piece labeled thereby is sorted into more than one genre. The conversion table TT is provided for recording a correspondence between each selection number CN and each style name ST in terms of style number SN. A data memory is provided in the form of ROM 3 for storing each style data SD of each music piece in correspondence to the style name ST of each music piece. The monitor display device 16 presents the selection numbers CN together with the style names ST according to the selection table CT in the sorted manner by the genres. A control is provided in the form of the console 15 to designate a selection number CN from a desired genre presented on the monitor display device 16. The CPU 1 converts the designated selection number CN into the corresponding style name ST by means of the conversion table TT for retrieving the style data SD from the data memory 3 according to the converted corresponding style name ST, thereby ensuring that the same style data SD is retrieved by designating one of the different selection numbers CN assigned to the same style name ST. Preferably, the style selection table CT records a set of selection numbers CN sequentially from the top selection number to the last selection number for each of the genres. In such a case, the monitor display device 16 is controlled to start to present the set of the selection numbers belonging to the desired genre from the top selection number when the console 15 is operated to designate the desired genre among the plurality of the genres.

Figure 4:
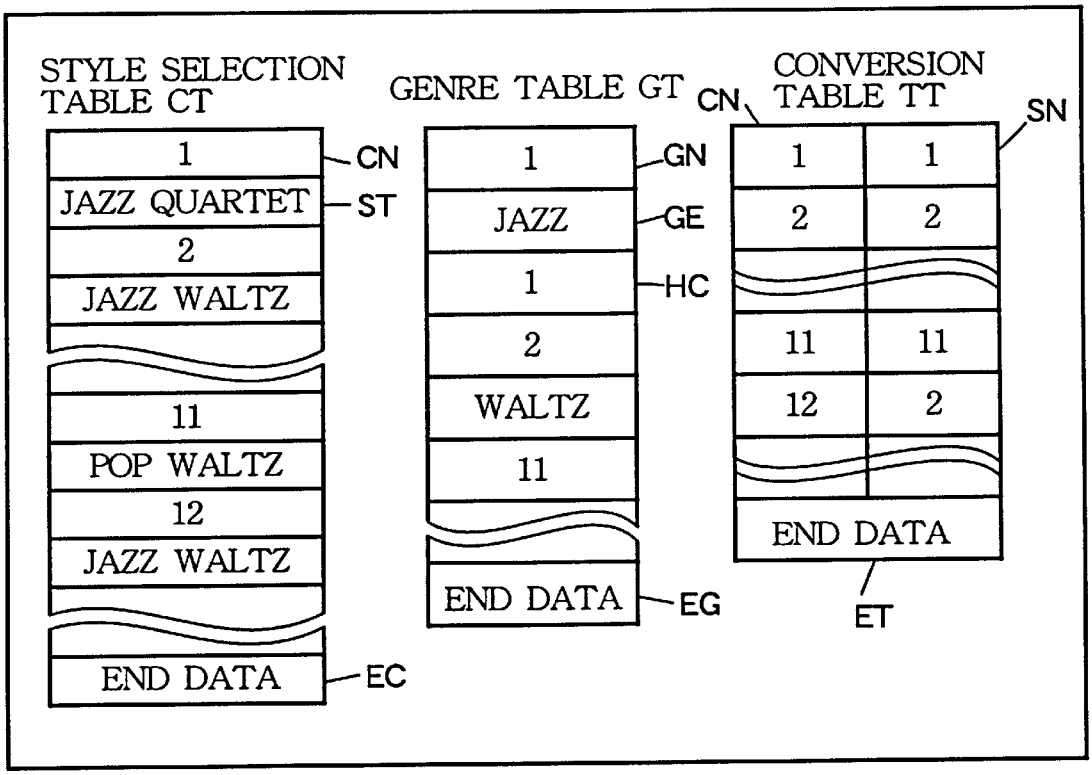
FIG. 4 is a diagram showing examples of various tables.
Figure 5:
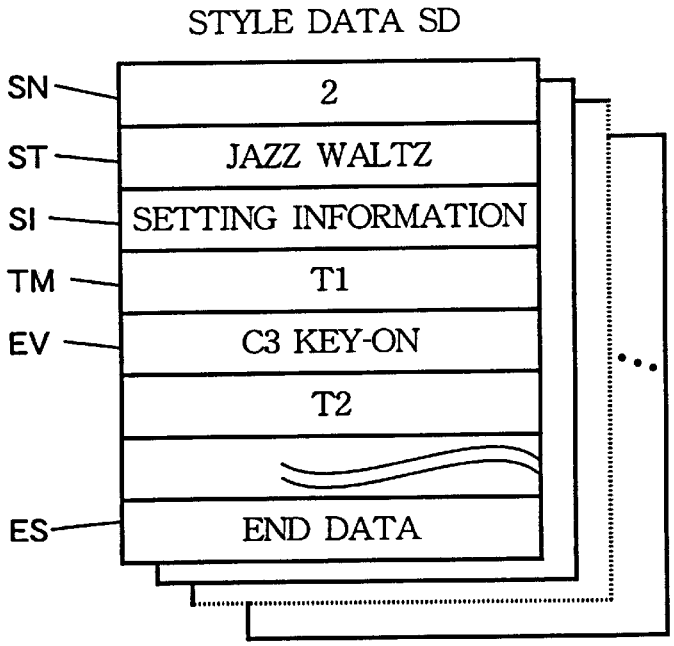
FIG. 5 is a diagram showing an example of style data.

FIG. 4 is a diagram showing specific examples of the various tables CT, GT and TT, and FIG. 5 is a diagram showing an example of the style data SD. Digits are employed as identification codes or the style selection numbers CN. In the example of the style selection table CT, all the styles that belong to the first genre, "jazz" are arranged sequentially in order, with style name ST="JAZZ QUARTET" entered for style selection number CN=1, style name ST="JAZZ WALTZ" entered for style selection number CN=2 . . . . Subsequently, all the styles that belong to the second genre "waltz" are arranged sequentially in order, with style name ST="POP WALTZ" entered for style selection number CN=11, style name ST="JAZZ WALTZ" entered for style selection number CN=12 . . . . In this case, the style labeled by the style name ST="JAZZ WALTZ" belongs to both of the genre "jazz" and the genre "waltz."

In the genre table GT, a set of the genre number GN=1, the genre GE=jazz and the first selection number HC=1 are arranged for the first genre. Another set of the genre number GN=2, the genre GE=waltz and the first selection number HC=11 are arranged for the second genre. That is, the first selection number HC for the first genre "jazz" is the style selection number CN=1 and corresponds to "JAZZ QUARTET," which is the first style belonging to this genre. In analogous manner, the first selection number HC of the second genre "waltz" is the style selection number CN=11 and corresponds to "POP WALTZ," which is the first style belonging to this genre.

Style selection numbers CN=1, 2, . . . , 11 and 12 in the style selection table CT of FIG. 4 are paired with style numbers SN=1, 2, . . . , 11 and 12 and correspond to respective ones of the style data SD which are the performance data group. These pairs are stored in the conversion table TT. FIG. 5 is a diagram showing example contents of the style data SD for the style name ST=JAZZ WALTZ denoted by style number SN=2. It is apparent from FIG. 5 that the style denoted by style number SN=2 can be selected from both the selection numbers CN=2 and 12.

Figure 6:
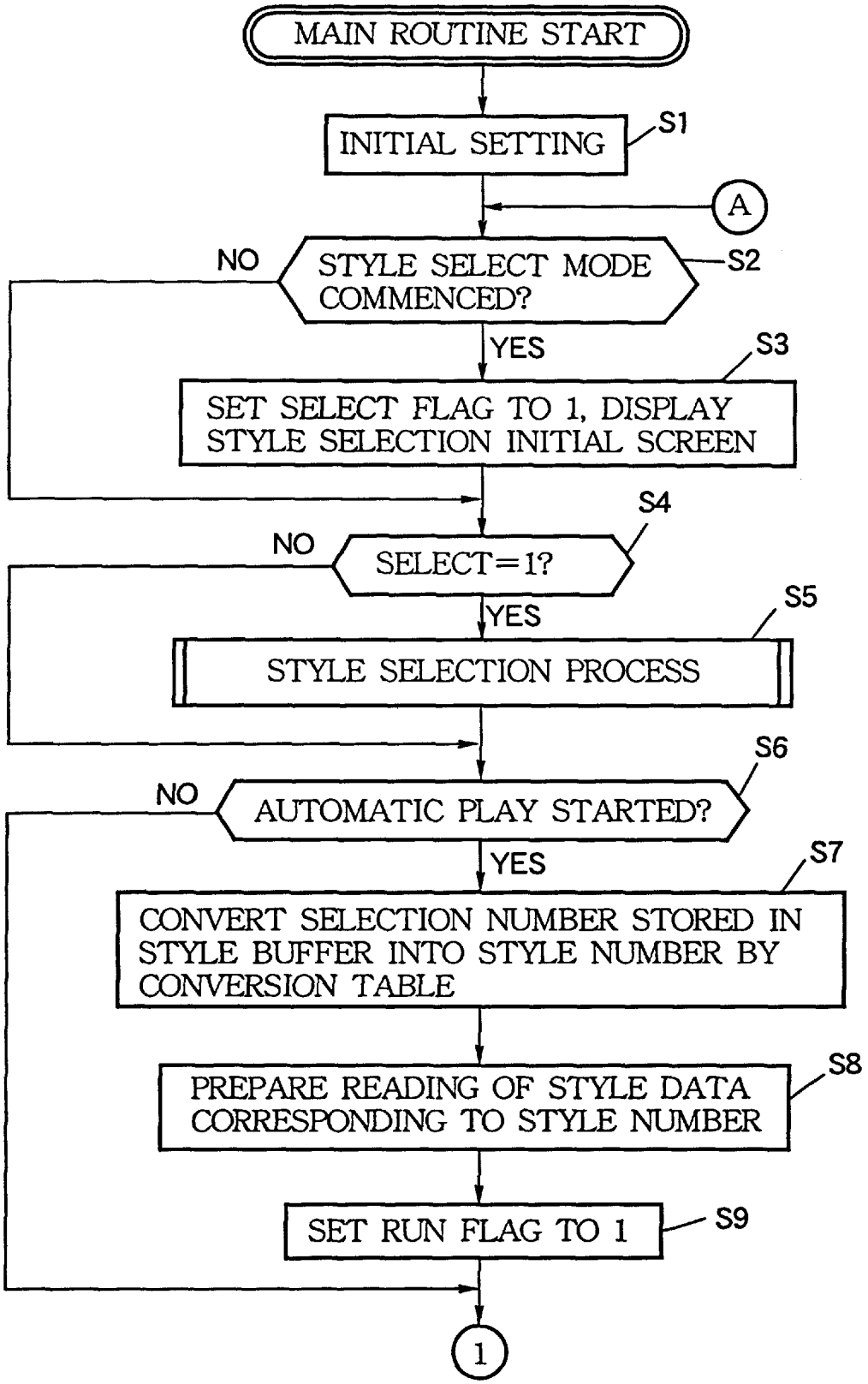
FIG. 6 is a flowchart showing one part of the main processing routine performed according to the embodiment of the present invention.
Figure 7:
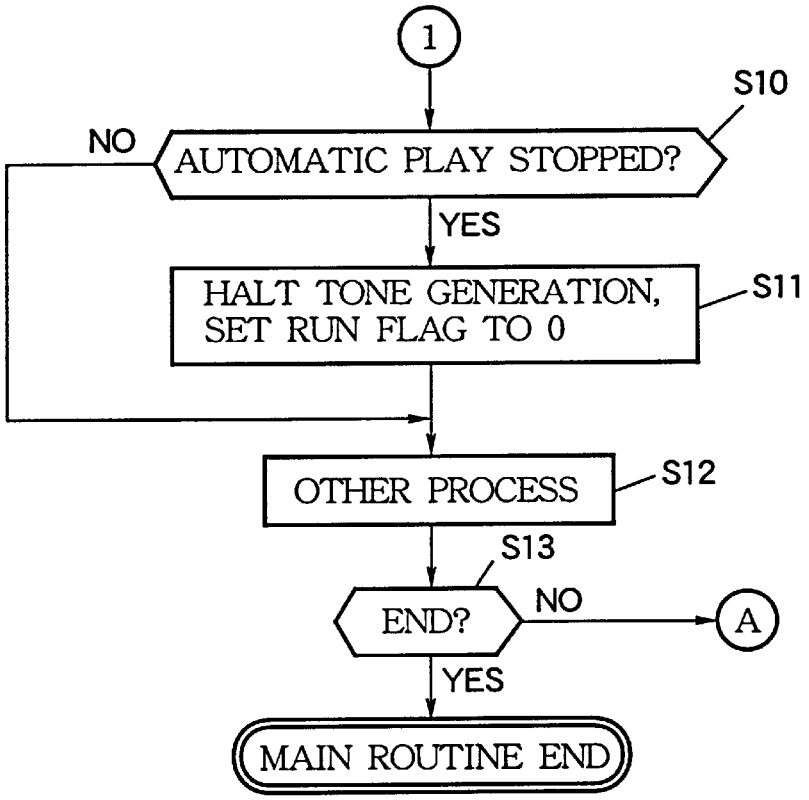
FIG. 7 is a flowchart showing the remaining part of the main processing routine performed according to the embodiment of the present invention.

FIGS. 6 and 7 are flowcharts showing the main processing routine performed for music selection by the music selection apparatus according to the embodiment of the present invention. The main processing routine is initiated when the system is powered on. First, at step S1, the initial setup is performed. At this step S1, an initial screen is displayed on the display device 16, and the initialization process is performed, such as resetting of various buffers and flags. For a default style selection number CN, a number "1" is stored in a STYLE buffer, and a value of "0" is set to a RUN flag and a SELECT flag, respectively.

The default style name ST and the genre name GE, which are determined in advance, and setting information such as tempo are displayed on the initial screen. In this embodiment, the default style name ST (e.g., JAZZ QUARTET) and the default genre name GE (e.g., JAZZ) specified by the default selection number CN=1 are displayed. The RUN flag is used to indicate whether or not the style data such as automatic accompaniment data or automatic performance data is currently being reproduced (i.e., whether the style data is being processed by the tone generator 9). The RUN flag is set to "1" when the reproduction is being performed, and is set to "0" otherwise. The SELECT flag is used to indicate whether or not the style name selection is currently being conducted. The SELECT flag is set to "1" during the selection process, and is set to "0" otherwise.

At step S2, a check is made to determine whether the style select mode start operation has been instructed by the manipulation of the switches on the console 15. If the mode select start has been instructed, the program control advances to step S3 and then to step S4. If the mode select start has not been instructed, the program control jumps to step S4. At step S3, the SELECT flag is set to "1" and an "initial style selection screen" is displayed on the display device 16. The program control then moves to step S4. The style name ST that is currently selected, and the corresponding selection number CN and genre name GE are displayed on the initial style selection screen. The style name ST that is displayed here can be changed by altering the displayed selection number CN using an INC/DEC operation switch that will be described later. Further, as will be also be described later, a genre can be selected by changing the displayed genre name GE.

At step S4, a check is made to determine whether the value "1" is set for the SELECT flag. When the value 1 is set for the SELECT flag, the program control moves to the style selection routine at step S5, and then goes to step S6. If the value 1 is not set for the SELECT flag, the program control jumps to step S6. At step S6, a check is made to determine whether automatic play has been started. When the automatic play has been started, the processes at S7 to S9 are performed and the program control thereafter goes to step S10. If the automatic play has not been started, the program control jumps to step S10.

At step S7, the selection number CN stored in the STYLE buffer is converted into the style number SN by referring to the conversion table TT (see FIGS. 2 and 4), and the converted style number SN is read out. That is, the style numbers SN that correspond to the respective selection numbers CN in the style selection table CT (see FIGS. 2 and 4) are stored in the conversion table TT. Therefore, even when the same style name ST (e.g., "JAZZ WALTZ") that belongs to different genres (e.g., jazz and waltz) is selected from either one of the associated genres, the same style data SD (e.g., SN=2) can be extracted from the data memory by referring to the table TT.

At step S8, the reading of style data SD (see FIGS. 3 and 5) that corresponds to the style number SN extracted at step S7 is prepared. Then, at step S9, the RUN flag is set to 1, and the program control moves to step S10 (FIG. 7). Specifically, at step S8, the setting information for the selected style data is read out so that various setups as to the play tempo and the timbre can be made, and preparation for the automatic play process that will be described later is performed. At step S9, the automatic play process is commenced.

At step S10, a check is made to determine whether the automatic play should be halted. When the automatic play should be halted, at step S11 the current tone generation is halted and the RUN flag is set to 0. The program control thereafter goes to step S12. If it is determined that the automatic play should not be halted, the program control jumps to step S12. At step S12, other processes including editing of the style data SD, setting of a tempo and a timbre and reproduction of style data are preformed. At step S13, a check is made to determine whether the main processing routine for the style selection should be terminated. If the main processing routine should be terminated, this processing routine is terminated. If the main processing routine should not be terminated, the program control returns to step S2 (FIG. 6).

Figure 8:
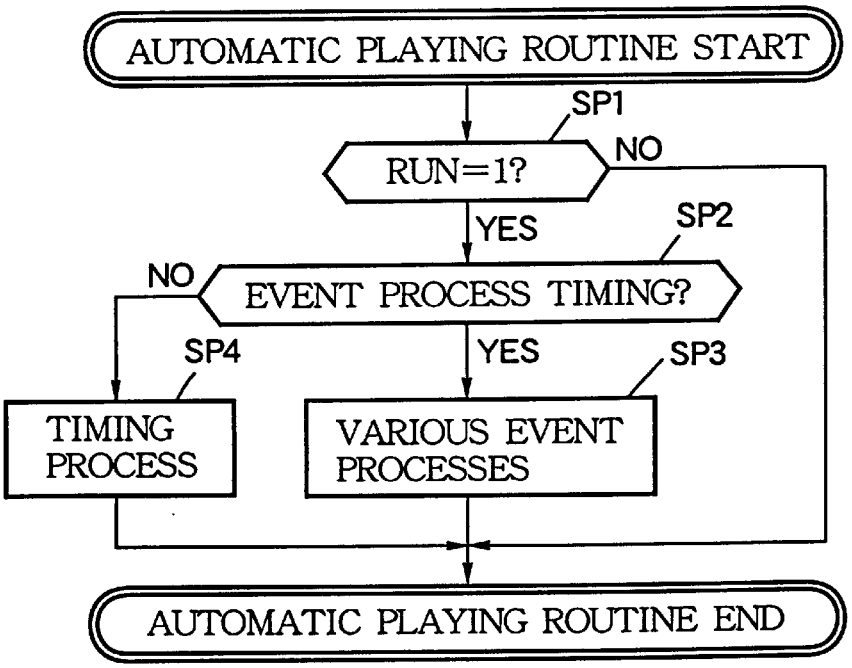
FIG. 8 is a flowchart showing an automatic accompaniment processing routine performed according to the embodiment of the present invention.

FIG. 8 is a flowchart showing the automatic play process that is performed in parallel with the main process. This is interrupt processing executed each time a clock is generated by the timer 2. When the automatic play process is called upon the generation of a timer interrupt, at step SP1, a check is made to determine whether the value 1 is set for the RUN flag. If the decision is NO, the automatic play process is immediately terminated. If the value 1 is set for the RUN flag (YES), and if it is ascertained at step SP2 that the current timing is event process timing, various event processes are performed at step SP3. Thereafter, the automatic play process is terminated. If the current timing is not event process timing, the timing process is conducted at step SP4, the timing process for counting clocks to advance the automatic play timing a period equivalent to one clock. Thereafter, the automatic play process is terminated.

Figure 9:
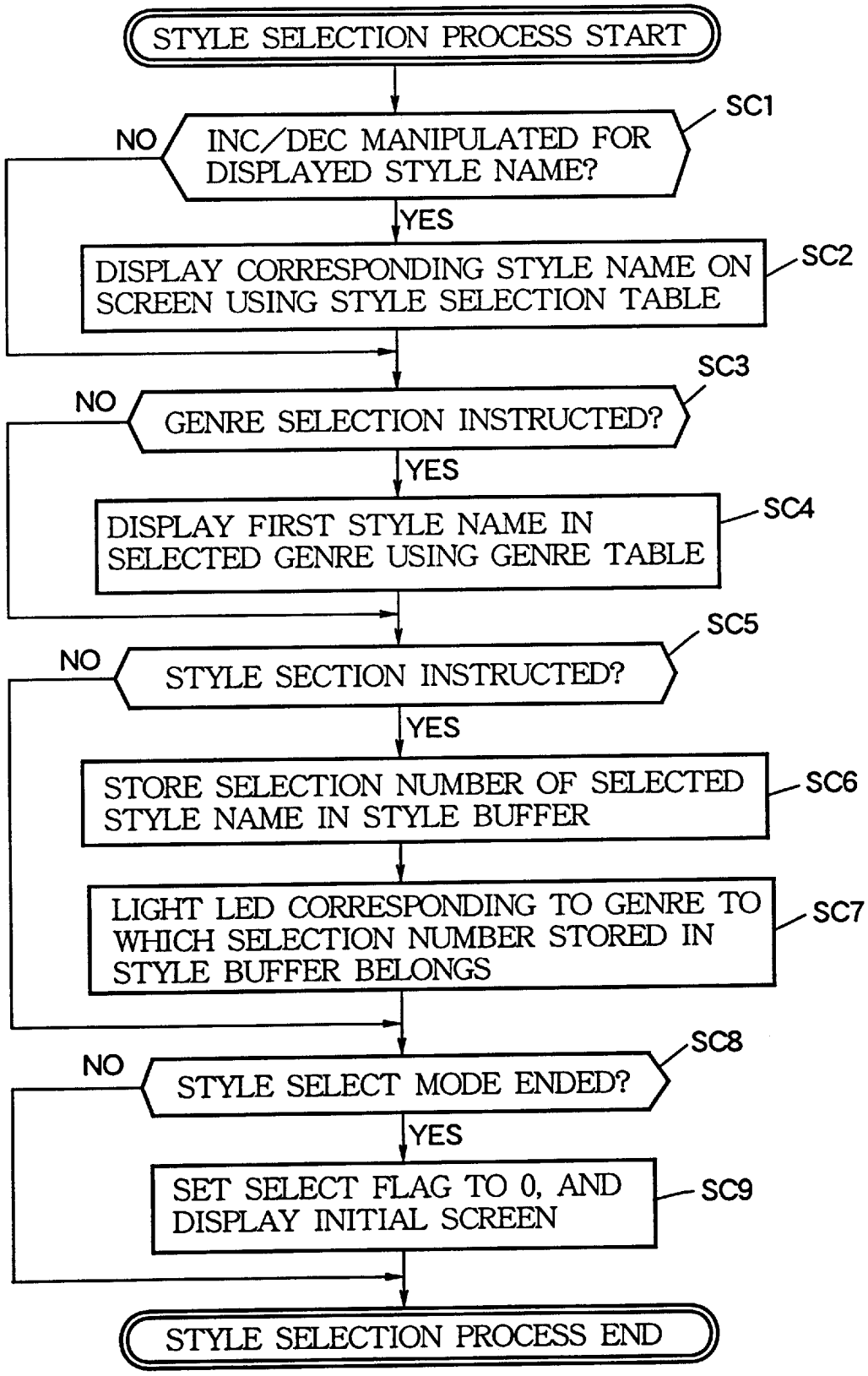
FIG. 9 is a flowchart showing a process performed for a style selection routine according to the embodiment of the present invention.

FIG. 9 is a flowchart showing the style selection process performed at step S5 of the main process routine. In the style selection process routine, first, at step SC1, a check is made to determine whether an INC/DEC instruction has been entered, i.e., whether the INC or DEC switch has been manipulated for the style name ST that is displayed on the screen of the display device 16. If such an instruction has been entered, the program control advances to step SC2 and then to step SC3. If an INC/DEC instruction has not been entered, the program control jumps to step SC3.

At step SC2, the style selection table CT (see FIGS. 2 and 4) is referred to, and the style name ST that is incremented or decremented by the INC or DEC switch is displayed on the screen. That is, since a pair consisting of the style name ST and the selection number CN are sequentially recorded for each genre in the style selection table CT, the style names ST in the style selection table CT are displayed sequentially downward or upward in the order by which they are recorded in the table CT. Further, since the style name ST that belongs to multiple genres is recorded with different selection numbers CN at pertinent genre locations in the style selection table CT, the corresponding style name ST is selected from any of the pertinent genres.

At step SC3, a check is made to determine whether the genre selection operation has been instructed. When this operation has been instructed, the program control advances to step SC4 and then to step SC5. If the genre selection operation has not been instructed, the program control jumps to step SC5. At step SC4, the genre table GT (see FIGS. 2 and 4) is referred to, and the first style name ST recorded at the top of the selected genre is displayed on the screen. The selection number HC of the first style of each genre is recorded for each genre in the genre table GT. Therefore, during the genre selection, a desired style name can be immediately searched from the selected and displayed genre.

At step SC5, a check is made to determine whether style selection has been instructed. If this instruction has been entered, the program control advances to step SC6, to step SC7 and then to step SC8. If the style selection has not been instructed, the program control jumps to step SC8. At step SC6, the selection number CN for the selected style ST is stored in the STYLE buffer. At step SC7, the genre indicator 14 turns on the LED lamp that corresponds to the genre covering the style denoted by the selection number CN stored in the STYLE buffer. At step SC7, the genre (GE) for the selected style is determined by comparing the style selection number CN stored in the STYLE buffer with each of the first selection number HC in the genre table GT. An LED lamp is provided for each genre on the genre indicator 14, and the LED lamp that corresponds to the determined genre is turned on. Therefore, the genre to which the currently selected style belongs can easily be determined and recognized. As for a style that belongs to a plurality of genres, one of the genres from which the target style has been selected can be ascertained.

At step SC8, a check is made to determine whether the style select mode end instruction has been entered. If this instruction has been entered, the program control advances to step SC9, whereat the SELECT flag is set to 0 and the screen that was initially displayed when the system was activated is again displayed on the display device 16. When the display process at step SC9 is completed, or when it is found at step SC8 that the end instruction has not been entered, the style selection process routine is terminated, and the program control goes to step S6 of the main process routine.

As described above, according to the second aspect of the invention, the music apparatus is constructed for selecting performance data of a music piece by designating a name of the music piece among a plurality of music pieces which are sorted by genres. In the inventive apparatus, the selection table CT is provided for recording selection numbers CN assigned to the names ST of the music pieces in a sorted manner by genres, such that different selection numbers CN may be assigned to the same name ST when the music piece labeled thereby is sorted into more than one genre. The data memory is provided in the form of ROM 3 for storing each performance data SD of each music piece in correspondence to the name ST of each music piece. The monitor display device 16 presents the selection numbers CN together with the names ST according to the selection table CT in the sorted manner by the genres. A control is provided in the form of the console 15 to designate a selection number CN from a desired genre presented on the monitor display device 16. The CPU 1 retrieves the performance data SD of the music piece from the data memory 3 according to the name ST of the music piece corresponding to the designated selection number CN. The genre indicator 14 is provided for visually indicating the desired genre to which the selected music piece belongs according to the designated selection number CN with reference to the selection table CT.

Figure 10:
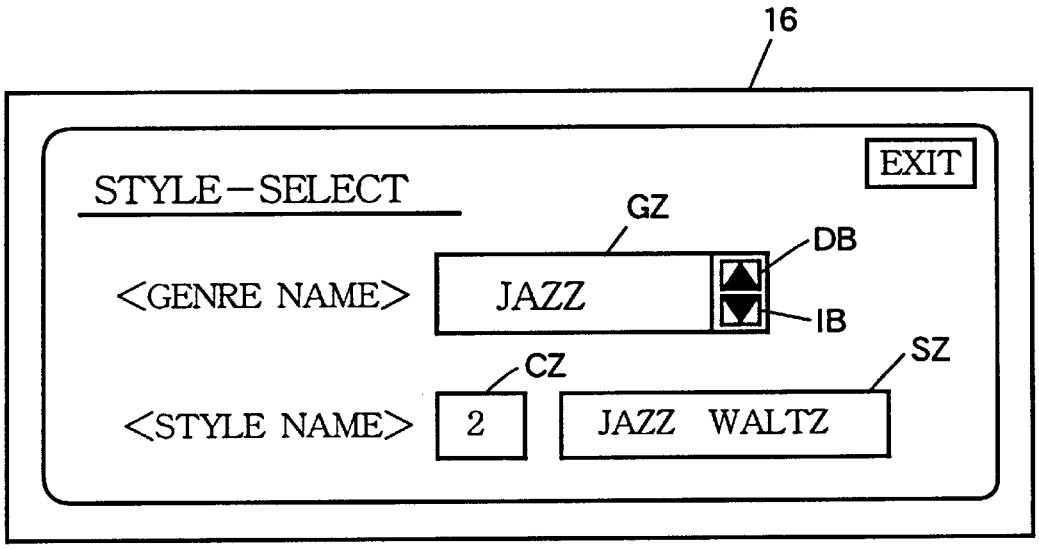
FIG. 10 is a diagram showing an example of a style selection screen provided by a display device.

FIG. 10 is a diagram showing an example of a style select screen displayed on the monitor display device 16. In this example, INC button IB and DEC button DB are employed instead of the INC and DEC switches on the console 15. That is, when the INC button IB is depressed once on the initial style selection screen of FIG. 10 on which the first genre name GE=jazz is displayed, the value of the style name, i.e., the selection number is incremented and is displayed as in FIG. 10. In this case, "jazz" is already displayed in the genre name display area GZ, and as the button IB is manipulated, the style selection number CN=2 is displayed in the style selection number display area CZ, and the style name ST=JAZZ WALTZ is displayed in the style name display area SZ.

In this display state, when the style select switch on the console 15 is manipulated, the selection number CN=2 (in area CZ) for the selected style is employed to search the conversion table TT for style number SN=2. With this style number, music style data that corresponds to the selected style name ST=JAZZ WALTZ (in area SZ) is retrieved from the ROM 3 in which the style data SD of FIG. 5 are stored. In addition, the LED lamp that is provided in the vicinity of the genre display names on the genre indicator 14 is turned on according to the style selection table CT of FIG. 4. In other words, when the LED lamp is turned on, it confirms that the selected style is a "jazz" genre that corresponds to the selection number CN=2 in the style selection table CT. In addition to the LED lamp being turned on, the genre name displayed in the genre name display area GZ can be highlighted by using blinking or inversion, or by changing the display color to red, for example.

In the display state in FIG. 10, when the DEC button DB is manipulated, the selection number CN=1 and the corresponding style name SN=JAZZ QUARTET for the first style in the jazz genre are displayed in the display areas CZ and SZ, respectively. Furthermore, when the genre select switch on the console 15 is manipulated, the selected genre name GE is displayed in the display area GZ, and the selection number CN and the style name ST for the first style that is recorded in the selected genre are displayed in the display areas CZ and SZ, respectively, by referring to the genre table GT. When, for example, the next genre, "waltz," is selected by manipulating the genre selection switch, "waltz," "11" and "POP WALTZ" are displayed in the areas GZ, CZ and SZ, respectively.

The music selection processing performed by this invention has been explained by employing one embodiment, but it can be variously modified. For example, in this embodiment, the genres of individual styles are determined by using the style selection table CT and the genre table GT. Alternatively, the style section table may be recorded for each genre without the genre table GT being prepared. In this case, instead of end data, the recording location of the style selection table corresponding to a succeeding genre that is to be referred to can be entered in the last position of the preceding style selection table that corresponds to a specific genre. Further, while in this embodiment, an identification code is not provided for each genre, such may be so provided.

As for a style data format, style data may be constituted by a plurality of tracks. In such a case, performance data along a plurality of tracks may be mixed or may not be mixed. The format of style data SD (see FIGS. 3 and 5) in this embodiment is an "event plus absolute time" form in which the time (TM) for determining an occurrence of a play event EV is represented by an absolute time in a music piece. However, as the format for style data SD, any form may be used such as an "event plus relative time" form in which the time for determining an occurrence of a play event is represented by the relative time that is measured from the end of a preceding event; a "pitch (rest) plus length of a note" form in which play data is represented by the pitch of a note and the length of a note or the length of a rest; or a "descriptive system" form in which a memory area is prepared for each minimum resolution for playing, and a play event is stored in the memory area that corresponds to the time for the occurrence of the play event. Further, performance data that correspond to types of introductions, fill-ins, mains and endings may be stored as individual style data.

In this embodiment, only one style name is displayed on the screen; however, a plurality of style names may be simultaneously displayed per genre. In this case, as many style names as possible that belong to the selected genre are displayed on the screen, so that the usability for style selection can be increased.

The machine readable medium M may be provided for use in the inventive music apparatus having the CPU 1. The medium M contains program instructions executable by the CPU 1 for performing the inventive process of selecting style data of a music piece as described above by designating a style name of the music piece among a plurality of music pieces which are sorted by genres. The process is performed by the steps of recording selection numbers CN in the style selection table CT, the selection numbers CN being assigned to the style names ST of the music pieces in a sorted manner by genres, such that different selection numbers CN may be assigned to the same style name ST when the music piece labeled thereby is sorted into more than one genre, registering a correspondence between each selection number CN and each style name ST in the conversion table TT, storing each style data SD of each music piece in the ROM 3 in correspondence to the style name ST of each music piece, presenting the selection numbers CN together with the style names ST on the monitor display device 16 according to the selection table CT in the sorted manner by the genres, designating a selection number CN from a desired genre presented on the monitor display device 16, converting the designated selection number CN into the corresponding style name ST by means of the conversion table TT, and retrieving the style data SD from the ROM 3 according to the converted corresponding style name ST, thereby ensuring that the same style data SD is retrieved by designating one of the different selection numbers CN assigned to the same style name ST.

As is described above, in the music selection apparatus of the present invention, upon receiving an instruction for selecting the style name of a music piece that belongs to a plurality of genres, the user can readily select style data for an object music piece. The music style selection table is prepared in which the style names of music pieces are recorded using different identification codes for the respective genres to which the music pieces belong. Then, music style data are stored in accordance with the corresponding style names, and the music style names that belong to each genre are displayed in accordance with the music selection table. The conversion table in which the music style data and their corresponding identification codes are stored is employed to extract, from among the style names displayed by the display device, the music style data that correspond to the selected style name. Specifically, the music style selection table is prepared to display the style name when a desired style is selected. Particularly for a style that belongs to a plurality of genres, the style name is recorded for all the pertinent genres, and in the reproduction of the style, the conversion table is employed to specify the style data. Thus, a style that belongs to a plurality of genres can be selected from one of the pertinent genres, and the search for the desired style can be easily performed.

According to the present invention, the style name that is first recorded in each genre in the music style selection table is displayed in accordance with the genre selection. Thus, the style names of a desired genre can be displayed sequentially and immediately from the first style name to the last style name of the designated genre.

According to the present invention, the music selection apparatus selects corresponding music data upon receiving an instruction for the name of a music piece that belongs to a plurality of genres. The music selection table is prepared in which the names of music pieces are recorded using different identification codes for the individual genres to which the musical selection belong. The names of the music pieces that belong to each genre are displayed in accordance with the music selection table. Based on the name of a displayed music piece, a corresponding genre in the music selection table is displayed. That is, in the selection of performance data or style data, for the name of a music piece or a style that belongs to a plurality of genres, different codes are provided in the music selection table for displaying the name of the music piece or the style. Then, using the identification code, the selected genre is identified and is displayed. Thus, when the music performance data or style data are selected, the associated genre can be readily recognized.

What is claimed is:

1. An apparatus for selecting style data of a music piece by designating a style name of the music piece among a plurality of music pieces which are sorted by genres, the apparatus comprising:

a style selection table that records selection codes assigned to the style names of the music pieces in a sorted manner by genres, such that different selection codes may be assigned to the same style name when the music piece labeled thereby is sorted into more than one genre;

a conversion table that records a correspondence between each selection code and each style name;

a data memory that stores each style data of each music piece in correspondence to the style name of each music piece;

a monitor that presents the selection codes together with the style names according to the style selection table in the sorted manner by the genres;

a control that can designate a selection code from a desired genre presented on the monitor; and a processor that converts the designated selection code into the corresponding style name by means of the conversion table for retrieving the style data from the data memory according to the converted corresponding style name, thereby ensuring that the same style data is retrieved by designating one of the different selection codes assigned to the same style name.

2. The apparatus according to claim 1, wherein the style selection table records a set of selection codes sequentially from a top selection code to a last selection code for each of a plurality of genres, and wherein the monitor starts to present the set of the selection codes belonging to the desired genre from the top selection code when the control designates the desired genre among the plurality of the genres.

3. The apparatus according to claim 1, further comprising an indicator that visually indicates the genre to which the selected music piece belongs according to the designated selection code with reference to the style selection table.

4. An apparatus for selecting performance data of a music piece by designating a name of the music piece among a plurality of music pieces which are sorted by genres, the apparatus comprising:

a selection table that records selection codes assigned to the names of the music pieces in a sorted manner by genres, such that different selection codes may be assigned to the same name when the music piece labeled thereby is sorted into more than one genre;

a data memory that stores each performance data of each music piece in correspondence to the name of each music piece;

a monitor that presents the selection codes together with the names according to the selection table in the sorted manner by the genres;

a control that can designate a selection code from a desired genre presented on the monitor;

a processor that retrieves the performance data of the music piece from the data memory according to the name of the music piece corresponding to the designated selection code; and an indicator that visually indicates the desired genre to which the selected music piece belongs according to the designated selection code with reference to the selection table.

5. An apparatus for selecting style data of a desired music piece, comprising:

a data memory that stores style data of a plurality of music pieces, which are sorted by genres such that one music piece may belong to a multiple of genres and another music piece may belong to a single of genres;

a first control that designates one of the genres so as to subject music pieces belonging to the designated genre for selection;

a second control that selects one of the music pieces belonging to the designated genre; and a processor that retrieves the style data of the selected music piece from the data memory, thereby ensuring that the style data of said one music piece belonging to the multiple genres is retrieved by designating any one of the multiple genres.

6. The apparatus according to claim 5, wherein the data memory stores the style data of the music pieces together with identification codes for use in selection of the music pieces such that said one music piece belonging to the multiple genres is allotted multiple identification codes in correspondence to the multiple genres.

7. The apparatus according to claim 6, further comprising an indicator that visually indicates the genre to which the selected music piece belongs according to the identification code, which is allotted in correspondence to the genre.

8. A method of selecting style data of a music piece by designating a style name of the music piece among a plurality of music pieces which are sorted by genres, the method comprising the steps of:

recording selection codes in a style selection table, the selection codes being assigned to the style names of the music pieces in a sorted manner by genres, such that different selection codes may be assigned to the same style name when the music piece labeled thereby is sorted into more than one genre;

registering a correspondence between each selection code and each style name in a conversion table;

storing each style data of each music piece in a data memory in correspondence to the style name of each music piece;

presenting the selection codes together with the style names on a monitor according to the style selection table in the sorted manner by the genres;

designating a selection code from a desired genre presented on the monitor;

converting the designated selection code into the corresponding style name by means of the conversion table; and retrieving the style data from the data memory according to the converted corresponding style name, thereby ensuring that the same style data is retrieved by designating one of the different selection codes assigned to the same style name.

9. The method according to claim 8, wherein the step of recording records a set of selection codes in the style selection table sequentially from a top selection code to a last selection code for each of a plurality of genres, and the step of presenting starts to present the set of the selection codes belonging to the desired genre from the top selection code when the desired genre is designated from among the plurality of the genres.

10. The method according to claim 8, further comprising the step of visually indicating the genre to which the selected music piece belongs according to the designated selection code by referencing to the style selection table.

11. A method of selecting performance data of a music piece by designating a name of the music piece among a plurality of music pieces which are sorted by genres, the method comprising the steps of:

recording selection codes in a selection table, the selection codes being assigned to the names of the music pieces in a sorted manner by genres, such that different selection codes may be assigned to the same name when the music piece labeled thereby is sorted into more than one genre;

storing each performance data of each music piece in a data memory in correspondence to the name of each music piece;

presenting the selection codes together with the names on a monitor according to the selection table in the sorted manner by the genres;

designating a selection code from a desired genre presented on the monitor;

retrieving the performance data of the music piece from the data memory according to the name of the music piece corresponding to the designated selection code; and visually indicating the desired genre to which the selected music piece belongs according to the designated selection code by referencing to the selection table.

12. A method of selecting style data of a desired music piece comprising the steps of:

storing style data of a plurality of music pieces in a data memory, the music pieces being sorted by genres such that one music piece may belong to a multiple of genres and another music piece may belong to a single of genres;

designating one of the genres so as to subject music pieces belonging to the designated genre for selection;

selecting one of the music pieces belonging to the designated genre; and retrieving the style data of the selected music piece from the data memory, thereby ensuring that the style data of said one music piece belonging to the multiple genres is retrieved by designating any one of the multiple genres.

13. A machine readable medium for use in an apparatus having a processor, the medium containing program instructions executable by the processor for causing the apparatus to perform a process of selecting style data of a music piece by designating a style name of the music piece among a plurality of music pieces which are sorted by genres, wherein the process is performed by the steps of:

recording selection codes in a style selection table, the selection codes being assigned to the style names of the music pieces in a sorted manner by genres, such that different selection codes may be assigned to the same style name when the music piece labeled thereby is sorted into more than one genre;

registering a correspondence between each selection code and each style name in a conversion table;

storing each style data of each music piece in a data memory in correspondence to the style name of each music piece;

presenting the selection codes together with the style names on a monitor according to the style selection table in the sorted manner by the genres;

designating a selection code from a desired genre presented on the monitor;

converting the designated selection code into the corresponding style name by means of the conversion table; and retrieving the style data from the data memory according to the converted corresponding style name, thereby ensuring that the same style data is retrieved by designating one of the different selection codes assigned to the same style name.

14. The machine readable medium according to claim 13, wherein the step of recording records a set of selection codes in the style selection table sequentially from a top selection code to a last selection code for each of a plurality of genres, and the step of presenting starts to present the set of the selection codes belonging to the desired genre from the top selection code when the desired genre is designated from among the plurality of the genres.

15. The machine readable medium according to claim 13, wherein the process further comprises the step of visually indicating the genre to which the selected music piece belongs according to the designated selection code by referencing to the style selection table.

16. A machine readable medium for use in an apparatus having a processor, the medium containing program instructions executable by the processor for causing the apparatus to perform a process of selecting performance data of a music piece by designating a name of the music piece among a plurality of music pieces which are sorted by genres, wherein the process is performed by the steps of:

recording selection codes in a selection table, the selection codes being assigned to the names of the music pieces in a sorted manner by genres, such that different selection codes may be assigned to the same name when the music piece labeled thereby is sorted into more than one genre;

storing each performance data of each music piece in a data memory in correspondence to the name of each music piece;

presenting the selection codes together with the names on a monitor according to the selection table in the sorted manner by the genres;

designating a selection code from a desired genre presented on the monitor;

retrieving the performance data of the music piece from the data memory according to the name of the music piece corresponding to the designated selection code; and visually indicating the desired genre to which the selected music piece belongs according to the designated selection code by referencing to the selection table.

17. A machine readable medium for use in an apparatus having a processor, the medium containing program instructions executable by the processor for causing the apparatus to perform a process of selecting style data of a desired music, wherein the process is performed by the steps of:

storing style data of a plurality of music pieces in a data memory, the music pieces being sorted by genres such that one music piece may belong to a multiple of genres and another music piece may belong to a single of genres;

designating one of the genres so as to subject music pieces belonging to the designated genre for selection;

selecting one of the music pieces belonging to the designated genre; and retrieving the style data of the selected music piece from the data memory, thereby ensuring that the style data of said one music piece belonging to the multiple genres is retrieved by designating any one of the multiple genres.

* * * * *